US009222305B2

(12) United States Patent
Di Stefano

(10) Patent No.: US 9,222,305 B2
(45) Date of Patent: Dec. 29, 2015

(54) WINDER ASSEMBLY

(71) Applicant: Carmelo Joseph Licciardi Di Stefano, Broadmeadows VIC (AU)

(72) Inventor: Carmelo Joseph Licciardi Di Stefano, Broadmeadows VIC (AU)

(73) Assignee: ACMEDA PTY LTD, Broadmeadows, VIC (AU)

( * ) Notice: Subject to any disclaimer, the term of this patent is extended or adjusted under 35 U.S.C. 154(b) by 0 days.

(21) Appl. No.: 14/054,364

(22) Filed: Oct. 15, 2013

(65) Prior Publication Data

US 2014/0131503 A1 May 15, 2014

(30) Foreign Application Priority Data

Nov. 9, 2012 (AU) ..... 2012101665

(51) Int. Cl.
*E06B 9/68* (2006.01)
*E06B 9/50* (2006.01)

(52) U.S. Cl.
CPC .... *E06B 9/68* (2013.01); *E06B 9/50* (2013.01)

(58) Field of Classification Search
CPC ..... E06B 9/68
USPC ..... 160/323.1, 324–326, 305, 306, 903
See application file for complete search history.

(56) References Cited

U.S. PATENT DOCUMENTS 4,399,857 A * 8/1983 Honma ..... 160/323.1
4,751,953 A * 6/1988 Appel et al. ..... 160/313
4,884,618 A * 12/1989 Steeves ..... 160/321
5,137,073 A * 8/1992 Huang ..... 160/321
5,507,374 A * 4/1996 Rude ..... 192/223.4
6,158,563 A * 12/2000 Welfonder et al. ..... 192/223.3
6,173,825 B1 * 1/2001 Liu ..... 192/223.4
6,457,688 B1 * 10/2002 Welfonder ..... 248/266
7,100,668 B2 * 9/2006 Allsop ..... 160/321
7,387,150 B2 * 6/2008 Liu ..... 160/321
7,497,242 B2 * 3/2009 Wang ..... 160/321
7,730,930 B2 * 6/2010 Malausa et al. ..... 160/310
8,004,224 B2 * 8/2011 Marchetto et al. ..... 318/466
8,136,569 B2 * 3/2012 Bohlen et al. ..... 160/323.1
8,151,859 B2 * 4/2012 Koop et al. ..... 160/325
8,403,020 B2 * 3/2013 Rasmussen ..... 160/120
8,408,486 B2 * 4/2013 Di Stefano ..... 242/407
8,418,742 B2 * 4/2013 Anderson et al. ..... 160/308
8,453,708 B2 * 6/2013 Rysholt ..... 160/323.1
8,556,059 B2 * 10/2013 Ng et al. ..... 192/223.4

(Continued)

FOREIGN PATENT DOCUMENTS

AU 2012100444 A4 5/2012
AU 2012101508 A4 11/2012
EP 2284353 A2 2/2011

*Primary Examiner* — Katherine Mitchell
*Assistant Examiner* — Justin Rephann
(74) *Attorney, Agent, or Firm* — Head, Johnson & Kachigian, P.C.

(57) ABSTRACT

A winder assembly for controlling the extension or retraction of a window covering, for example a roller blind. The winder assembly includes a spindle having a head, a shaft extending from the head, and a location lug also extending from the head, in the direction of the shaft. The winder assembly further includes a drive mechanism operable to control the extension and retraction of the window covering by rotation of the drive mechanism about the spindle, and a spindle cover. The spindle cover itself includes an opening through which the shaft of the spindle passes, the cover releasably engaging the head of the spindle, and at least one location aperture receiving the location lug to define at least one position of the spindle relative to the cover.

3 Claims, 5 Drawing Sheets

(56) References Cited

U.S. PATENT DOCUMENTS

| | | | | |
|---|---|---|---|---|
| 8,695,681 | B2 * | 4/2014 | Daniels | 160/323.1 |
| 2003/0085003 | A1 * | 5/2003 | Cheng | 160/321 |
| 2004/0163774 | A1 * | 8/2004 | Nien et al. | 160/168.1 P |
| 2005/0039866 | A1 * | 2/2005 | Allsopp | 160/321 |
| 2005/0072534 | A1 * | 4/2005 | Braybrook | 160/167 R |
| 2008/0202709 | A1 * | 8/2008 | Anderson et al. | 160/321 |
| 2010/0276530 | A1 * | 11/2010 | Di Stefano | 242/370 |
| 2010/0288451 | A1 * | 11/2010 | Bohlen | 160/291 |
| 2011/0005694 | A1 * | 1/2011 | Ng | 160/311 |
| 2011/0297334 | A1 * | 12/2011 | Bohlen et al. | 160/310 |
| 2012/0067530 | A1 * | 3/2012 | Barnes et al. | 160/326 |
| 2012/0193042 | A1 * | 8/2012 | Koop et al. | 160/323.1 |
| 2014/0014280 | A1 * | 1/2014 | Bohlen | 160/291 |
| 2014/0041815 | A1 * | 2/2014 | Kao | 160/319 |

* cited by examiner

WINDER ASSEMBLY

BACKGROUND OF THE INVENTION

This invention relates generally to a fitting for window coverings, in particular, a winder assembly for controlling the extension and retraction of a screen of a blind system.

PRIOR ART

A winder assembly refers to a user-operated blind component (or fitting) that is rotatable for, for example, extending and retracting a window covering such as a window blind. Such fittings typically have a drive mechanism that is rotatable about a spindle, and engages a cord (for example, a beaded cord or chain). Operation of the cord causes the drive mechanism to rotate about the spindle. For example, the cord may be pulled in one direction to rotate the fitting in a blind extending direction, and the cord may be pulled in an opposite direction to rotate the fitting in a blind retracting direction.

A cover is generally provided to prevent disengagement of the drive mechanism from the spindle, or the disengagement of the cord from the drive mechanism. In some winder assemblies, the cover is a separate component to the spindle, which may be engaged with the spindle in two or more positions. In one position, relative rotation between the spindle and cover may be prevented (e.g. a fixed or locked position), whereas in another position, the cover may be able to rotate to some degree relative to the spindle (e.g. a swivel position). The swivel position allows the angle of the cover to be changed relative to the rest of the winder assembly, and is favoured by users who wish to operate the cord while standing away from the window.

One problem with prior art winder assemblies of this type is that the spindle and the cover may accidentally disengage at undesired times—for example, when the spindle and cover are engaged in a fixed position, operation of the cord may occasionally disengage the cover from the spindle. The cover may remain disengaged for some time, which increases the possibility of the cord also becoming disengaged from the drive mechanism. In some cases, the cover may in due course re-engage with the spindle, but at an undesired position (e.g. the swivel position).

It is therefore desired to address the above issue, or to at least provide a useful alternative to existing winder fittings.

SUMMARY OF THE INVENTION

Accordingly, in a first aspect of the present invention, there is provided winder assembly for a window covering comprising:

(a) a spindle comprising:
  (i) a head;
  (ii) a shaft extending from the head; and
  (iii) a location lug extending from the head in the direction of the shaft;
(b) a drive mechanism operable to control the extension and retraction of the window covering by rotation of the drive mechanism about the spindle; and
(c) a cover comprising:
  (i) an opening through which the shaft of the spindle passes, the cover releasably engaging the head of the spindle; and
  (ii) at least one location aperture receiving the location lug to define at least one position of the spindle relative to the cover, wherein the location lug has a pair of divergent walls extending outwardly from the head, and wherein the location aperture has a pair of divergent walls, at least one of that pair being engagable with at least one of the of the pair of divergent walls of the location lug.

The location aperture may be a fixed position aperture, wherein the pair of divergent walls of the location aperture engage the pair of divergent walls of the location lug.

In other embodiments, the location aperture may be a swivel position aperture, wherein the location lug is movable within the location aperture to define a path of rotational movement between the spindle and the cover.

Some embodiments of the present invention may comprise both a swivel position aperture and a fixed position aperture, allowing a user to select whether to allow rotation of the cover relative to the spindle.

The divergent walls may be straight side walls of the location lug, which are inclined or angled to diverge as they extend away from the head of the spindle. Alternatively, they may provide a curved or stepped divergence.

The location apertures may be radial extensions of the opening. Alternatively, they may be discrete apertures which are separated from the opening by a part of the cover.

The location lug may extend radially outward from the shaft of the spindle, such that it widens as it extends further from the shaft.

In a second aspect of the present invention, there is provided a spindle for a winder assembly comprising:

(i) a head;
(ii) a shaft extending from the head; and
(iii) a location lug extending from the head in the direction of the shaft, wherein the location lug has a pair of divergent walls extending outwardly from the head.

In a third aspect of the present invention, there is provided a cover for a winder assembly comprising:

(i) an opening to receive a shaft of a spindle of the assembly; and
(ii) at least one location aperture to receive the location lug on the spindle to define at least one position of the spindle relative to the cover, wherein the location aperture has a pair of divergent walls.

A detailed description of one or more embodiments of the invention is provided below, along with accompanying figures that illustrate by way of example the principles of the invention. While the invention is described in connection with such embodiments, it should be understood that the invention is not limited to any embodiment. On the contrary, the scope of the invention is limited only by the appended claims and the invention encompasses numerous alternatives, modifications and equivalents.

For the purpose of example, numerous specific details are set forth in the following description in order to provide a thorough understanding of the present invention. The present invention may be practiced according to the claims without some or all of these specific details. For the purpose of clarity, technical material that is known in the technical fields related to the invention has not been described in detail so that the present invention is not unnecessarily obscured.

For the purposes of providing a clear description of the present invention, terms such as "front" and "rear" are used in the below descriptions. This terminology will be understood to be for illustrative purposes only, and does not limit the scope of the present invention.

BRIEF DESCRIPTION OF DRAWINGS

Various embodiments/aspects of the invention will now be described with reference to the following drawings in which.

DETAILED DESCRIPTION

Figure 1:
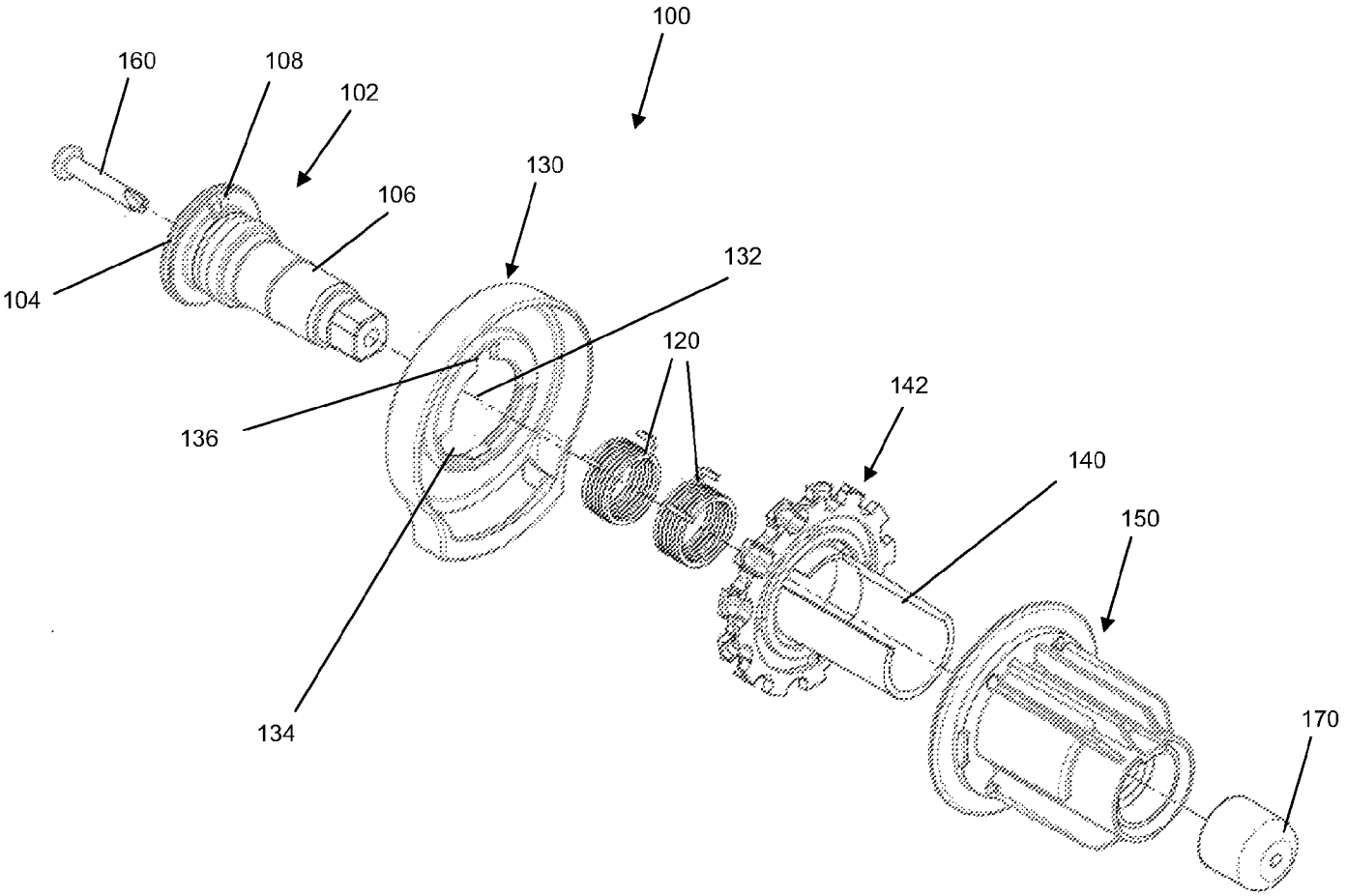
FIG. 1 is an exploded view of a winder assembly according to an embodiment of the present invention.
Figure 2:
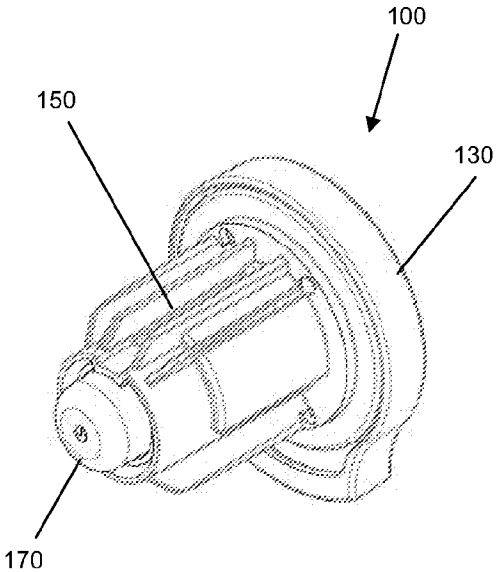
FIG. 2 is a rear perspective view of the winder assembly of FIG. 1, assembled.

A winder assembly 100, as shown in FIG. 1, is suitable for use to raise or lower a roller blind. The winder assembly 100 includes a spindle 102 having a head 104 and a shaft 106. A lug 108 extends from a rearward face of the head 104 in the direction of the shaft 106, generally parallel to the axis of the shaft 106. A cover 130 is mounted on the spindle 102 to releasably engage the head 104 of the spindle 102, with the shaft 106 of the spindle 102 passing through an opening 132 in the cover 130, so that the two parts snap together with the cover 130 releasably engaging the head 104 of the spindle 102. The winder assembly 100 further includes a drive mechanism, comprising an inner core 140 and an outer drive element 150, as well as a pair of clutch members 120. The winder assembly 100 is held in its assembled state by screw 160 and end cap 170, as shown in FIG. 2, although other fastening methods may be used in different embodiments of the invention.

In use, the winder assembly will typically be mounted to a supporting structure of some form—for example, a supporting frame or mounting bracket, with the spindle being fixed to that supporting structure. The outer drive element 150 has a plurality of fins around its outer surface, which are able to engage within a tube (not shown). A screen blind may be rolled around the tube. To raise or lower the blind, a cord (for example, a bead cord) is engaged with the inner core 140, by teeth 142 around one end of the inner core 140. This means that pulling of the cord rotates the drive mechanism about the spindle 102, and is operable to raise or lower the blind. The clutch members 120 resist unwanted rotation of the outer drive element 150 about the spindle 102.

Figure 6:
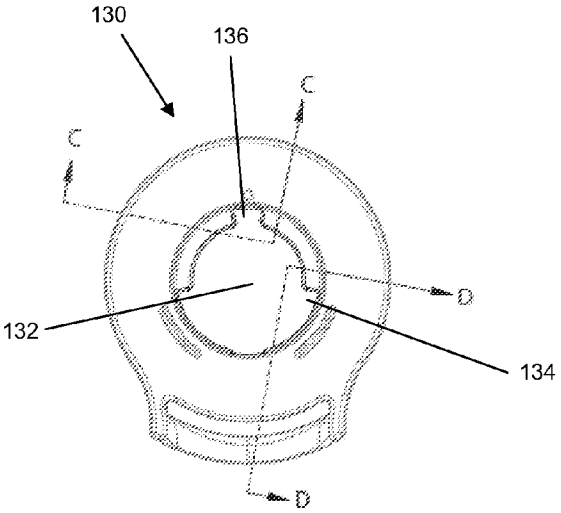
FIG. 6 is a front view of a cover according to an embodiment of the present invention.

In order to better show relevant features of the present invention, FIGS. 3 to 10 show the spindle 102 and cover 130, independently of the other components of the winder assembly 100. The cover 130, as best seen in FIG. 6, comprises an opening 132 through its centre, to receive the shaft 106 of the spindle 102. It also comprises two additional location apertures (swivel position aperture 134, and fixed position aperture 136) for engaging with the lug 108 on the spindle 102, in two positions—a swivel position, and a fixed position. The location apertures are, in this embodiment, extended portions of the opening 132, but in other embodiments they may be separated from the opening by a part of the body of the cover 130.

Figure 4:
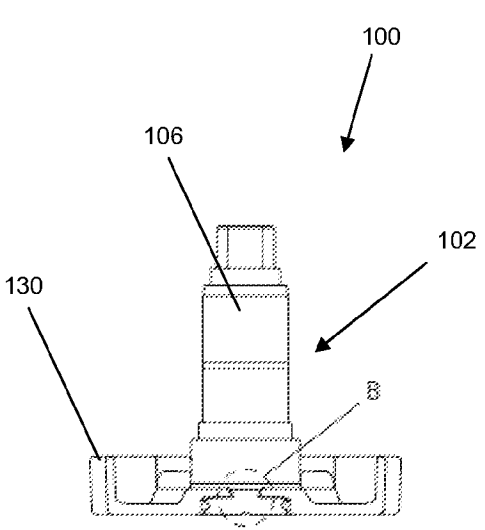
FIG. 4 is a transverse section view A-A of the spindle and cover in FIG. 3.
Figure 3:
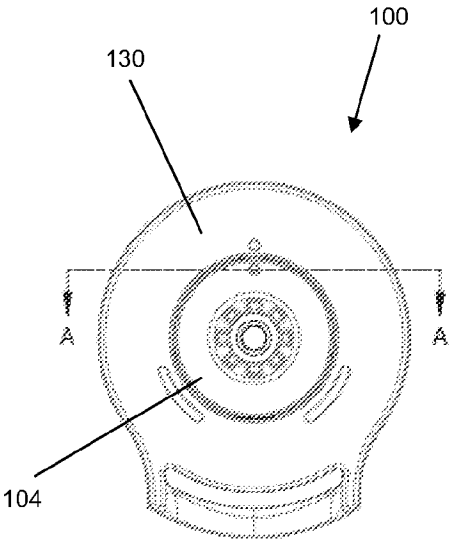
FIG. 3 is a front view of a spindle and cover according to an embodiment of the present invention.
Figure 5:
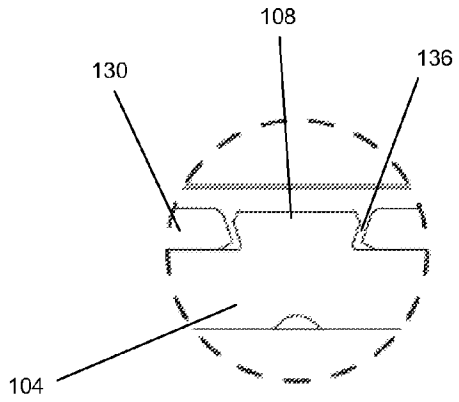
FIG. 5 is an enlarged view of the area marked 'B' in FIG. 4.
Figure 8:
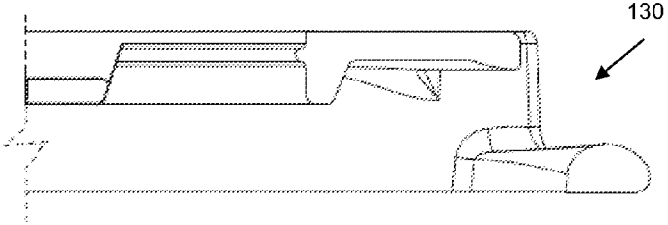
FIG. 8 is an enlarged section view D-D of the cover of FIG. 6.
Figure 7:
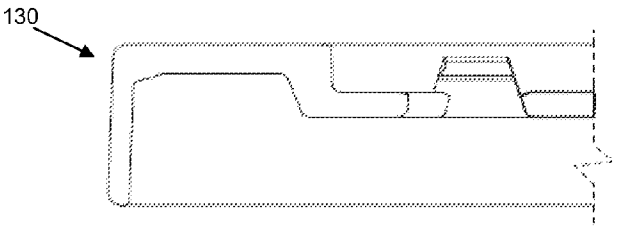
FIG. 7 is a an enlarged section view C-C of the cover of FIG. 6.
Figure 9:
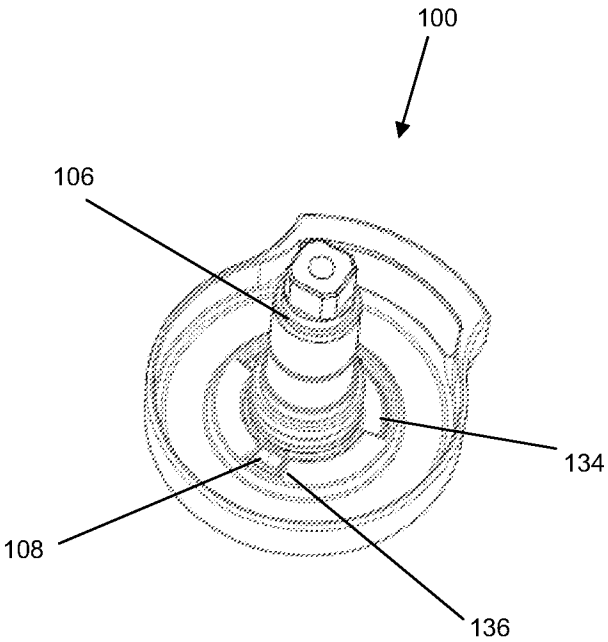
FIG. 9 is a perspective view of the spindle and cover of FIG. 3, with the spindle in a fixed position.
Figure 11:
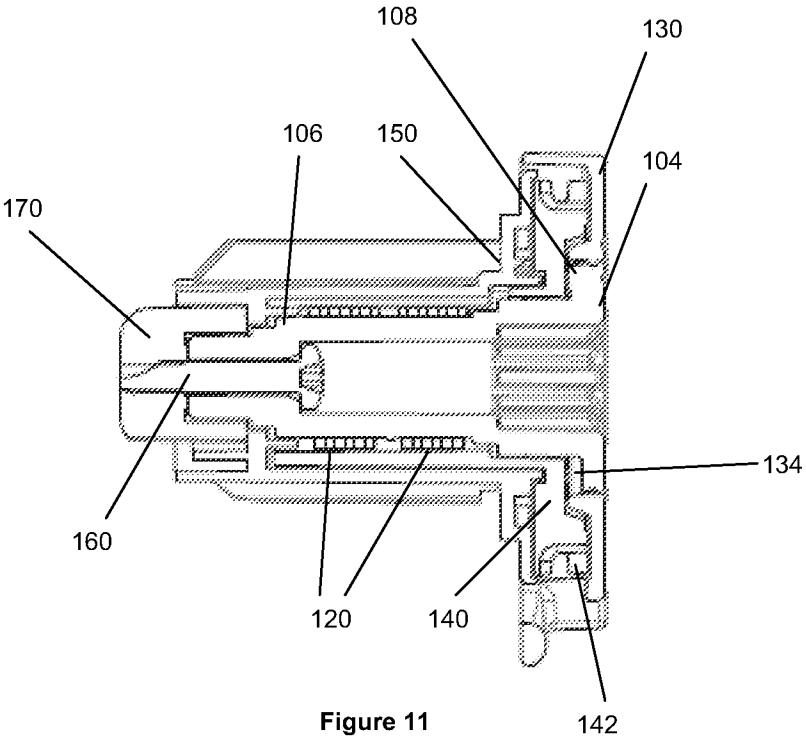
FIG. 11 is a transverse longitudinal section view of the winder assembly of FIG. 1, assembled with the spindle in the fixed position.

FIGS. 4, 5 and 9 shows the spindle 102 and cover 130 engaged in the fixed position. In this position, the lug 108 engages within the fixed position aperture 136. When in the fixed position, the spindle 102 and cover 130 are engaged such that they will not rotate relative to each other.

Figure 10:
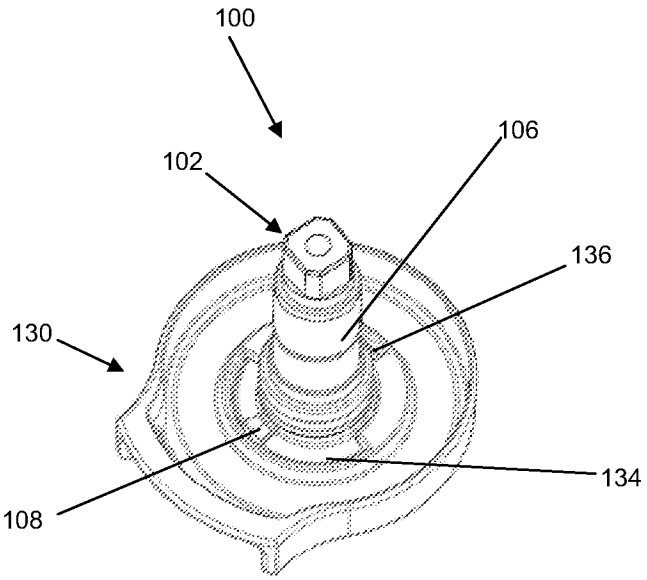
FIG. 10 is a perspective view of the spindle and cover of FIG. 3, with the spindle in a swivel position.

On the other hand, in the swivel position as shown in FIG. 10, the lug 108 is located within the swivel aperture 134 of the cover 130. It will be appreciated that, to assemble the depicted winder assembly 100 in the swivel position, the orientation of the spindle 102 will be changed from the orientation shown in FIG. 1, so that the lug 108 is at the bottom of the head 104, underneath the shaft 106. Since the swivel aperture 134 is of the same depth as the lug 108, but is much wider than the lug 108, it allows rotation of the cover 130 relative to the spindle 102 —the lug 108 is moveable from one end of the swivel aperture 134 to the other through rotation of the cover 130. This embodiment of the invention allows rotation of the cover 130 through almost 180 degrees in the swivel position, although other embodiments may allow a larger or smaller freedom of rotation.

The shape of the lug 108 facilitates an improved engagement between the lug 108 and the location apertures 134, 136. As best seen in the detailed view of FIG. 5, the side walls of the lug 108 diverge as they extend outwardly from the head 104 of the spindle 102. In this embodiment, the side walls of the lug 108 are simply straight walls which are angled with respect to the rearward face of the head 104.

FIG. 5 also clearly shows how the side walls of the fixed position aperture 136 also diverge. In this embodiment, the side walls of the fixed position aperture are also straight side walls, at an angle to the main plane of the cover 130, to match the angle of the side walls of the lug 108.

If a twisting, rotational or other force is applied to disengage the cover 130 from the head 104 of the spindle 102 the corresponding angled side walls of the lug 108 and the fixed position aperture 136 will simply be driven into tighter engagement, due to the respective angled side walls. This will resist the disengagement force. Consequently, a winder assembly 100 in accordance with the present invention will be more difficult to accidentally disengage from the fixed position.

The dimensions of the fixed position aperture 136 will substantially match the dimensions of the lug 108. However, typically some clearance will be provided, to allow the winder assembly 100 to be more easily assembled. In most cases, therefore, when a force is applied to disengage the cover 130 from the spindle 102 as described above, only one of the divergent side walls of the lug 108 will engage with a corresponding side wall of the fixed position aperture 136.

However, there may be some embodiments where the lug 108 is tightly engaged or snap fit in the fixed position aperture 136—for instance, if the lug 108 is formed of a resilient material. In these embodiments, with a tight fit between the lug 108 and fixed position aperture 136, both side walls of the lug 108 may engage with the respective side walls of the fixed position aperture 136 at the same time.

The side walls of the swivel position aperture 134 are, in this embodiment, also angled to match the divergence of the side walls of the lug 108. Accordingly, when the cover 130 is at either end of its freedom of rotation, the lug 108 will engage with one of the side walls of the swivel position aperture 134. It will accordingly resist disengagement in a similar manner to that described above in relation to the fixed position aperture 136, with the lug 108 engaging one of the side walls at either end of the swivel position aperture 134, depending on the direction of twist or rotation applied by the force.

As can be seen from the figures, the lug 108 of this embodiment of the present invention also widens as it extends radially outward from the shaft 106 of the spindle 102. The side walls of the location apertures 134, 136 match this radial widening.

It will be appreciated that the precise shape of the lug 108 may vary in different embodiments of the present invention. In particular, the side walls of the lug 108 may be curved (concave or convex) or stepped, rather than straight, and still provide improved resistance to disengagement of the spindle 102 from the cover 130. The profile of the side walls of the location apertures 134, 136 would typically correspond to the profile of the side walls of the lug 108.

The components of the winder assembly 100, including the spindle 102 and cover 130, may be formed from plastic, metal, or other material, and may be diecast or machined, depending on manufacturer or consumer preferences.

It will also be appreciated that the precise shape of the cover 130, and especially its outer shape, may vary in different embodiments of the invention. The shape of the cover 130 depicted in the Figures is an example given for illustrative purposes only.

The word 'comprising' and forms of the word 'comprising' as used in this description and in the claims does not limit the invention claimed to exclude any variants or additions.

Modifications and improvements to the invention will be readily apparent to those skilled in the art. Such modifications and improvements are intended to be within the scope of this invention.

In this specification where a document, act or item of knowledge is referred to or discussed, this reference or discussion is not an admission that the document, act or item of knowledge or any combination thereof was at the priority date, publicly available, known to the public, part of the common general knowledge; or known to be relevant to an attempt to solve any problem with which this specification is concerned.

What is claimed is:

1. A winder assembly for a window covering comprising:

(a) a spindle comprising:

(i) a head;

(ii) a shaft having an axis, said shaft extending axially from the head; and (iii) a location lug extending from the head in a direction parallel to the axis of the shaft;

(b) a drive mechanism operable to control the extension and retraction of the window covering by rotation of the drive mechanism about the spindle; and (c) a cover comprising:

(i) an opening through which the shaft of the spindle passes, the cover releasably engaging the head of the spindle; and (ii) at least one location aperture receiving the location lug to define at least one position of the spindle relative to the cover, wherein the location lug has a pair of side walls each extending divergently outwardly from the head divergent from the axial direction of the shaft, and wherein the location aperture has a pair of side walls each extending divergently from the axial direction of the shaft, at least one of the pair of divergent side walls of the location aperture being engagable with at least one of the pair of divergent side walls of the location lug.

2. The winder assembly of claim 1, wherein the pair of divergent side walls of the location aperture engage the pair of divergent side walls of the location lug.

3. The winder assembly of claim 1, wherein the location lug is movable within the location aperture to define a path of rotational movement between the spindle and the cover.

* * * * *